US012754002B2

(12) United States Patent
De Vries et al.

(10) Patent No.: US 12,754,002 B2
(45) Date of Patent: Oct. 6, 2026

(54) EXTERNAL HOMOGENIZATION SYSTEMS AND METHODS RELATED THERETO

(71) Applicant: Dyno Nobel Asia Pacific Pty Limited, Southbank (AU)

(72) Inventors: Ben De Vries, Singleton (AU); Jeff Gore, Singleton (AU); Nathan Paris, Singleton (AU); Savas Samat, Singleton (AU); Zoe Smith, Singleton (AU)

(73) Assignee: Dyno Nobel Asia Pacific Pty Limited, Southbank (AU)

( * ) Notice: Subject to any disclaimer, the term of this patent is extended or adjusted under 35 U.S.C. 154(b) by 0 days.

(21) Appl. No.: 18/597,422

(22) Filed: Mar. 6, 2024

(65) Prior Publication Data

US 2024/0318946 A1 Sep. 26, 2024

Related U.S. Application Data

(62) Division of application No. 16/353,918, filed on Mar. 14, 2019, now Pat. No. 11,953,306.

(30) Foreign Application Priority Data

Mar. 16, 2018 (AU) ..... 2018900878

(51) Int. Cl.
*F42D 1/10* (2006.01)

(52) U.S. Cl.
CPC ..... *F42D 1/10* (2013.01)

(58) Field of Classification Search
None
See application file for complete search history.

(56) References Cited

U.S. PATENT DOCUMENTS

| | | | |
|---|---|---|---|
| 3,288,658 | A | 11/1966 | Ferguson et al. |
| 3,424,438 | A | 1/1969 | Knotts et al. |
| 3,447,978 | A | 6/1969 | Bluhm |
| 3,610,088 | A | 10/1971 | Christensen et al. |
| 3,617,401 | A | 11/1971 | Mortensen et al. |
| 3,774,496 | A | 11/1973 | Roach |

(Continued)

FOREIGN PATENT DOCUMENTS

| | | | |
|---|---|---|---|
| AU | 5704590 | A | 12/1990 |
| AU | 7902294 | A | 6/1995 |

(Continued)

OTHER PUBLICATIONS

International Search Report and Written Opinion dated May 20, 2019 for PCT/AU2019/050234.

(Continued)

*Primary Examiner* — Aileen B Felton
(74) *Attorney, Agent, or Firm* — Dorsey & Whitney LLP

(57) ABSTRACT

Systems for delivering explosives including homogenizing agents and methods of delivering explosives including homogenizing agents are provided. Methods of mixing homogenizing agents with emulsion matrices are also provided. The methods can include supplying an emulsion matrix, mixing a homogenizing agent with the emulsion matrix into a mixed product, and homogenizing the mixed product into a homogenized product. The homogenized product can be sensitized and/or conveyed to a blasthole.

20 Claims, 7 Drawing Sheets

(56) References Cited

U.S. PATENT DOCUMENTS

| | | | | |
|---|---|---|---|---|
| 4,014,655 | A * | 3/1977 | Brunnberg | C06B 21/0008 149/66 |
| 4,138,281 | A | 2/1979 | Olney et al. | |
| 4,410,378 | A * | 10/1983 | Hattori | C06B 21/0008 149/46 |
| 4,511,414 | A * | 4/1985 | Matsui | C06B 47/145 149/46 |
| 4,526,633 | A | 7/1985 | Lawrence et al. | |
| 4,555,278 | A | 11/1985 | Cescon et al. | |
| 4,693,763 | A | 9/1987 | Ross et al. | |
| 4,823,561 | A | 4/1989 | Medlock | |
| 4,995,925 | A | 2/1991 | Engsbraeten | |
| 5,322,576 | A | 6/1994 | Aitken et al. | |
| 6,165,297 | A | 12/2000 | Smith et al. | |
| 10,495,432 | B2 | 12/2019 | Halander et al. | |
| 10,723,670 | B2 | 7/2020 | Mcphail et al. | |
| 2003/0201041 | A1* | 10/2003 | Hales | C06B 47/145 149/46 |
| 2004/0065396 | A1 | 4/2004 | Alilovic et al. | |
| 2014/0216289 | A1* | 8/2014 | Halander | F42D 1/10 102/313 |
| 2014/0311634 | A1 | 10/2014 | Mcphail et al. | |
| 2020/0249001 | A1 | 8/2020 | Halander et al. | |

FOREIGN PATENT DOCUMENTS

| | | | |
|---|---|---|---|
| CA | 1244244 | A | 11/1988 |
| CN | 88100209 | A | 8/1988 |
| CN | 1255911 | A | 6/2000 |
| CN | 201125221 | Y | 10/2008 |
| CN | 108299134 | A | 7/2018 |
| CN | 111440038 | A | 7/2020 |
| EA | 028758 | B1 | 12/2017 |
| EP | 0372739 | A2 | 6/1990 |
| EP | 0655430 | A1 | 5/1995 |
| EP | 252625 | | 1/1998 |
| ES | 2698102 | T3 | 1/2019 |
| RU | 166228 | U1 | 11/2016 |
| RU | 2652714 | C1 | 4/2018 |
| WO | 199724298 | | 7/1997 |
| WO | 200102318 | | 11/2001 |
| WO | 2013071363 | | 2/2013 |
| WO | 2014123562 | A1 | 8/2014 |

OTHER PUBLICATIONS

Notice of Allowance dated Dec. 6, 2023 for U.S. Appl. No. 16/353,918.

Office Action dated Feb. 24, 2023 for U.S. Appl. No. 16/353,918.

* cited by examiner

EXTERNAL HOMOGENIZATION SYSTEMS AND METHODS RELATED THERETO

RELATED APPLICATIONS

This application is a divisional of U.S. patent application Ser. No. 16/353,918, filed Mar. 14, 2019, and titled EXTERNAL HOMOGENIZATION SYSTEMS AND METHODS RELATED THERETO, which claims priority to Australian Patent Application No. 2018900878, filed Mar. 16, 2018, and titled EXTERNAL HOMOGENIZATION SYSTEMS AND METHODS RELATED THERETO, each of which is hereby incorporated by reference herein in its entirety.

TECHNICAL FIELD

The present disclosure relates generally to explosives. More specifically, the present disclosure relates to external homogenization systems and methods related thereto.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Figure 1:
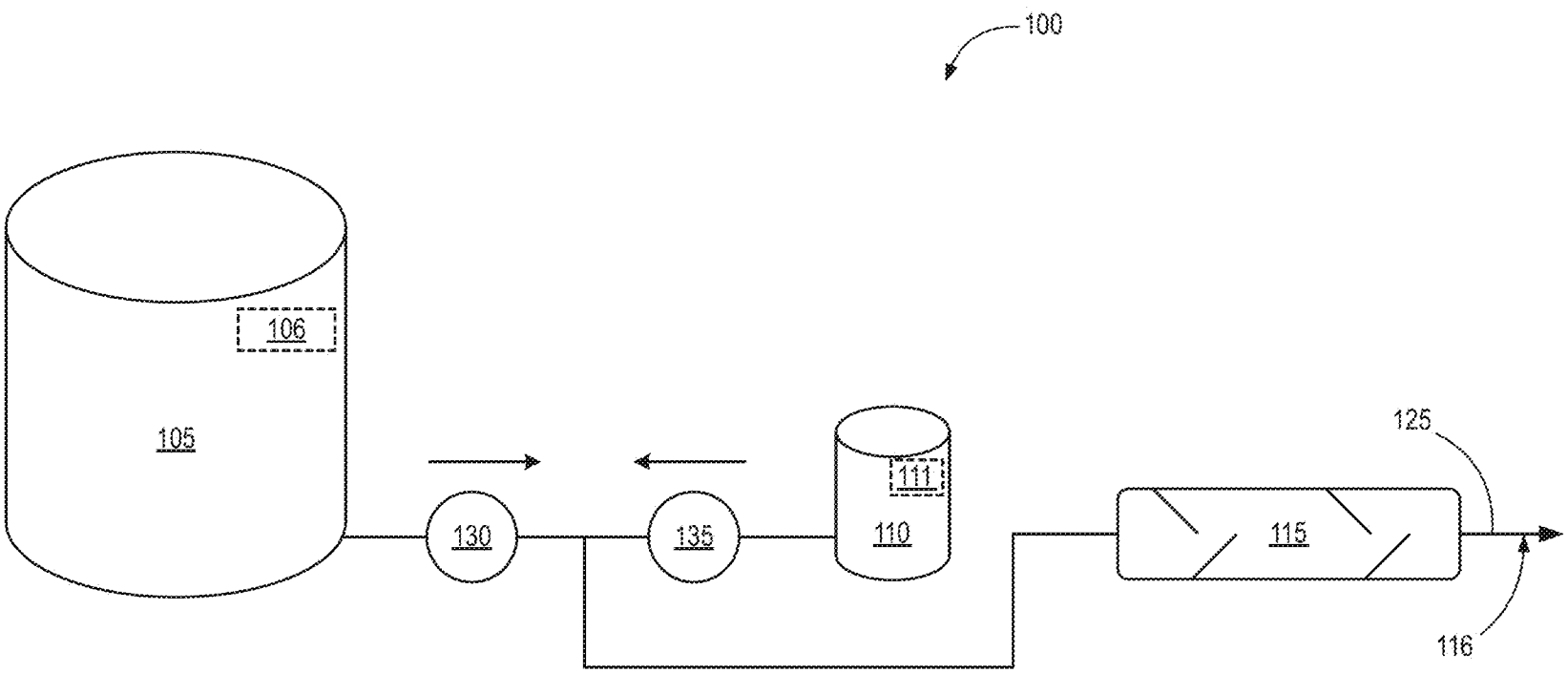
FIG. 1 is a process flow diagram of an embodiment of an explosives delivery system.

Emulsion explosives are commonly used in the mining, quarrying, and excavation industries for breaking rocks and ore. Generally, a hole, referred to as a "blasthole," is drilled in a surface, such as the ground. Emulsion explosives may then be pumped or augered into the blasthole. Emulsion explosives are generally transported to a bench as oxidizers and not as explosives. In general, the emulsion needs to be "sensitized" in order for the emulsion to become an explosive and detonate successfully. Sensitizing is often accomplished by introducing small voids into the emulsion. These voids act as hot spots for propagating detonation. These voids may be introduced by blowing a gas into the emulsion and thereby forming gas bubbles, adding microspheres or other porous media, and/or injecting chemical gassing agents to react in the emulsion and thereby form gas.

Some emulsion matrices may be configured for underground use (also referred to herein as an underground emulsion matrix) and some emulsion matrices may be configured for surface use (also referred to herein as a surface emulsion matrix). Underground emulsion matrices may include in the fuel phase a homogenizing agent. This increases the viscosity of the underground emulsion matrix and allows it to be used in an up-hole application.

The homogenizing agent may assist in increasing the viscosity of the underground emulsion matrix when shear is applied on the underground emulsion matrix. Shear (e.g., a shearing action) can reduce the droplet size of the underground emulsion matrix and can increase the solid-like behavior of the underground emulsion matrix. An increase in the solid-like behavior of the underground emulsion matrix can result in the underground emulsion matrix being retained in the hole and not falling or slumping out of the hole. However, the presence of a homogenizing agent in the underground emulsion matrix can decrease the shelf life of the underground emulsion matrix. For example, if an underground emulsion matrix including a homogenizing agent comes into contact with particulates (e.g., ammonium nitrate particulates in ammonium nitrate fuel oil (ANFO)) the shelf life of the underground emulsion matrix may be further decreased.

Generally, surface emulsion matrices may have a reduced viscosity relative to underground emulsion matrices. Surface emulsion matrices, for example, may not include a homogenizing agent because: surface emulsion matrices do not need to be retained in up-holes; surface emulsion matrices generally require a reasonable shelf life; and/or emulsion matrices including a homogenizing agent may become blocked in a mobile processing unit (e.g., a truck) if the emulsion matrix becomes sheared and the homogenization agent is activated (as surface mobile processing units are not generally designed to deliver highly sheared emulsion matrices).

Due at least in part to the differences between underground and surface emulsion matrices as described above (e.g., the presence or absence of a homogenizing agent, respectively), an explosives manufacturer may need to manufacture separate underground and surface emulsion matrices. Accordingly, multiple reservoirs to store different fuel phases and/or multiple reservoirs to store different emulsion matrices may be required. Furthermore, the market for underground emulsion matrices is generally smaller than the market for surface emulsion matrices. Accordingly, explosives manufacturers and/or suppliers may only have one or two underground emulsion matrix products (which are generally high energy), and as such, there may be over-blasting of the ground. Furthermore, use of bulk products in development headings can be limited due to the potential for back break.

In various embodiments, an emulsion matrix including one or more of the following features may be desirable: configuration for use in both surface and underground applications; a shelf life comparable to current surface emulsion matrices (i.e., shelf life comparable to emulsion matrices devoid or substantially devoid of a homogenizing agent); an increase in viscosity when shear is applied to the emulsion matrix; and/or retainability of the emulsion matrix in an up-hole without a substantial reduction in the sleep time of the emulsion matrix.

Systems for delivering explosives and methods related thereto are disclosed herein. It will be readily understood that the components of the embodiments as generally described below and illustrated in the Figures herein could be arranged and designed in a wide variety of different configurations. Thus, the following more detailed description of various embodiments, as described below and represented in the Figures, is not intended to limit the scope of the disclosure, but is merely representative of various embodiments. While the various aspects of the embodiments are presented in drawings, the drawings are not necessarily drawn to scale unless specifically indicated.

The phrases "operably connected to," "connected to," and "coupled to" refer to any form of interaction between two or more entities, including mechanical, electrical, magnetic, electromagnetic, fluid, and thermal interaction. Likewise, "fluidically connected to," and "fluidically coupled to" refers to any form of fluidic interaction between two or more entities. Two entities may interact with each other even though they are not in direct contact with each other. For example, two entities may interact with each other through an intermediate entity.

The phrase "substantially devoid of a homogenizing agent" is used herein to mean almost and including 100% devoid. An emulsion matrix that is substantially devoid of a homogenizing agent may include some homogenizing agent, but not enough to achieve target viscosities. For example, the homogenizing agent may be present in quantities at less than 0.05 weight percent of the emulsion matrix and be considered "substantially devoid of a homogenizing agent." In some embodiments, an emulsifier may be present and the emulsion matrix still considered "substantially devoid of a homogenizing agent," such as when the emulsifier is distinct from the homogenizing agent and the later-added homogenizing agent is not an emulsifier. The term "emulsifier" refers to a composition that stabilizes the liquid interface between different liquids in an emulsion.

In some embodiments of an explosives delivery system, the system may include a first reservoir configured to store an emulsion matrix and a second reservoir configured to store a homogenizing agent. The system may also include a first homogenizer configured to homogenize the emulsion matrix and the homogenizing agent into a first homogenized product, wherein the first homogenizer may be operably connected to the first reservoir and the second reservoir. Additionally, the system may include a delivery conduit operably connected to the first homogenizer, wherein the delivery conduit may be configured to convey the homogenized product to a blasthole.

In some embodiments of a method of delivering explosives, the method may include supplying an emulsion matrix and mixing a homogenizing agent with the emulsion matrix into a mixed product. The method may also include homogenizing the mixed product into a homogenized product, sensitizing the homogenized product. Additionally, the method may include conveying the sensitized product to a blasthole.

FIG. 1 illustrates a process flow diagram of one embodiment of an explosives delivery system 100. The explosives delivery system 100 of FIG. 1 comprises various components and materials as further detailed below. Additionally, any combination of the individual components may comprise an assembly or subassembly for use in connection with an explosives delivery system.

In some embodiments, the explosives delivery system 100 includes a first reservoir 105 configured to store an emulsion matrix 106, a second reservoir 110 configured to store a homogenizing agent 111, and a first mixer 115 configured to mix the emulsion matrix 106 and the homogenizing agent 111 into a mixed product 116. The first mixer 115 can be operably connected to the first reservoir 105 and the second reservoir 110. Furthermore, a delivery conduit 125 may be operably connected to the first mixer 115, wherein the delivery conduit 125 is configured to convey the mixed product 116 to a mobile processing unit. The first reservoir 105 can be for bulk storage of emulsion matrix 106, such as a surface emulsion matrix. For example, the system 100 can be used to load the emulsion matrix reservoir of an underground mobile processing unit. One benefit of the system 100 is that the underground mobile processing unit can be loaded with an emulsion matrix with detonation properties selected to match the material to be blasted, but that also has a homogenization agent. Once ultimately delivered to an up-hole blasthole, the emulsion matrix can have sufficient viscosity to be retained in the blasthole, and detonation characteristics matched to the material to be blasted and sufficiently devoid of crystallization to properly detonate.

In certain embodiments, the explosives delivery system 100 can further include a first pump 130. A first inlet of the first pump 130 can be fluidically connected to the first reservoir 105 and a first outlet of the first pump 130 can be fluidically connected to the first mixer 115. The explosives delivery system 100 can further include a second pump 135. A first inlet of the second pump 135 can be fluidically connected to the second reservoir 110 and a first outlet of the second pump 135 can be fluidically connected to the first mixer 115. In some embodiments, the explosives delivery system 100 can include a single pump (e.g., a monopump).

In various embodiments, the emulsion matrix 106 can include a continuous fuel phase and a discontinuous oxidizer phase. Any emulsion matrix known in the art may be used. The phrase "homogenizing agent" refers to any composition that promotes an increase in viscosity of an emulsion matrix upon subjection of the emulsion matrix to shear stress. Such homogenizing agents may promote the formation of relatively small droplets of the discontinuous oxidizer phase upon subjection of the emulsion matrix to shear stress. In some embodiments, the homogenizing agent 111 can be selected from at least one of sorbitan monooleate (SMO), sorbitan dioleate, sorbitan trioleate, sorbitan sesquioleate, sorbitan diisostearate, oleic acid, oleic acid TEA, oleic acid/stearate TEA, adipic DEEA, adipic TEA, animal fats such as lard, PIBSA, PIBSA derivatives, dicarboxylic acids, dimerized fatty acids, trimerized fatty acids, and vegetable oil. In some embodiments, the homogenizing agent 111 can be selected from at least one of SMO, sorbitan dioleate, sorbitan trioleate, sorbitan sesquioleate, sorbitan diisostearate, oleic acid, oleic acid TEA, oleic acid/stearate TEA, adipic DEEA, and adipic TEA. In some embodiments, the homogenizing agent 111 comprises SMO.

In some embodiments, the first mixer 115 may include a static mixer. An example of a static mixer includes, but is not limited to, a helical static mixer. Any static mixer known in the art and compatible with mixing the emulsion matrix 106 and the homogenizing agent 111 may be used.

Figure 2:
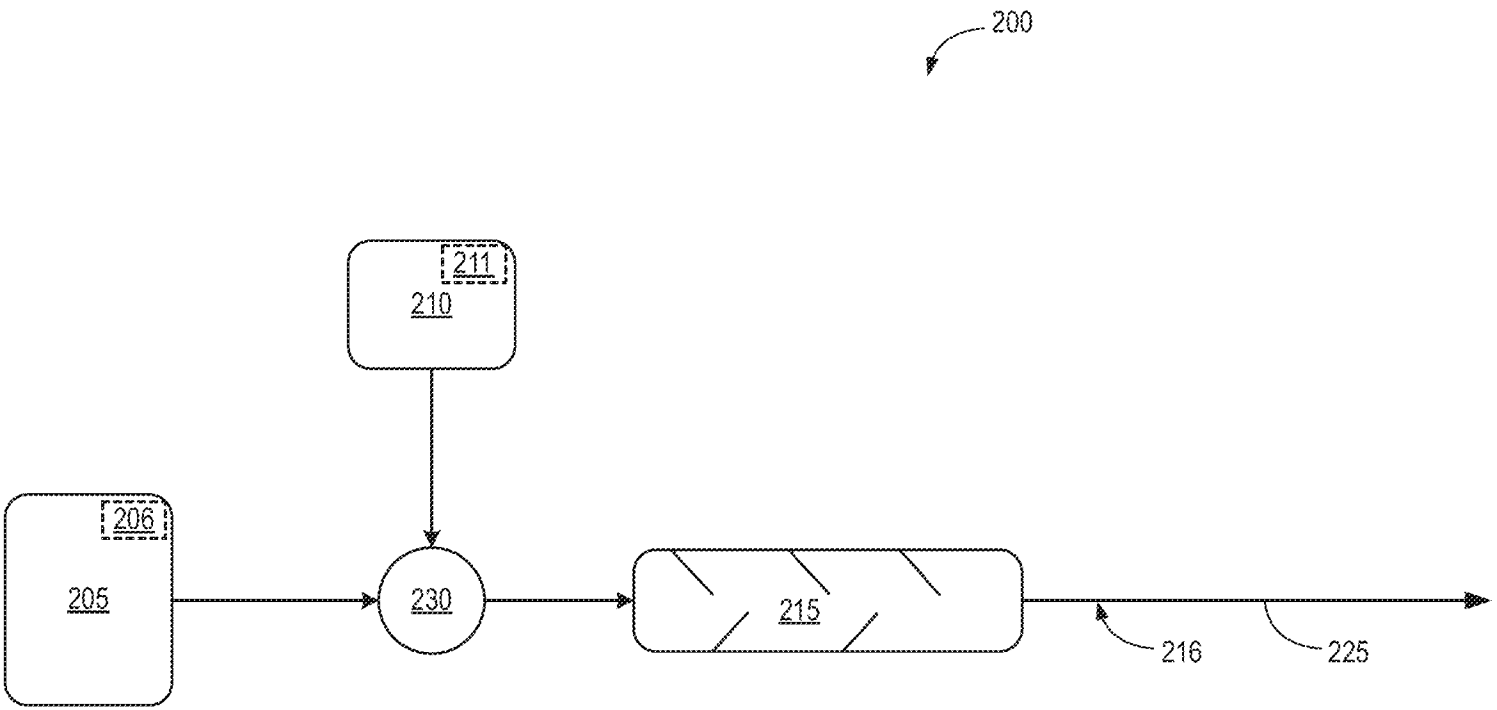
FIG. 2 is a process flow diagram of another embodiment of an explosives delivery system.

FIG. 2 illustrates a process flow diagram of an explosives delivery system 200 that can resemble the explosives delivery system 100 described above in many respects. Accordingly, like features are designated with like reference numerals, with the leading digits incremented to "2." Relevant disclosure set forth above regarding similarly identified features thus may not be repeated hereafter. Moreover, specific features of the explosives delivery system 200 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the explosives delivery system 200. Any suitable combination of the features and variations of the same described with respect to the explosives delivery system 100 can be employed with the explosives delivery system 200, and vice versa. This pattern of disclosure applies equally to further embodiments depicted in subsequent Figures and described hereafter, wherein the leading digits may be further incremented.

As shown in FIG. 2, the explosives delivery system 200 can include a first reservoir 205 configured to store an emulsion matrix 206, a second reservoir 210 configured to store a homogenizing agent 211, and a first mixer 215 configured to mix the emulsion matrix 206 and the homogenizing agent 211 into a mixed product 216.

The first mixer 215 can be operably connected to the first reservoir 205 and the second reservoir 210. Furthermore, a delivery conduit 225 may be operably connected to the first mixer 215, wherein the delivery conduit 225 is configured to convey the mixed product 216 to a mobile processing unit. As with the system 100, the system 200 can be used to load the emulsion matrix reservoir of an underground mobile processing unit.

In certain embodiments, the explosives delivery system 200 can further include a pump 230 (e.g., a monopump). A first inlet of the pump 230 can be fluidically connected to the first reservoir 205, a second inlet of the pump 230 can be fluidically connected to the second reservoir 210, and a first outlet of the pump 230 can be fluidically connected to the first mixer 215.

Figure 3:
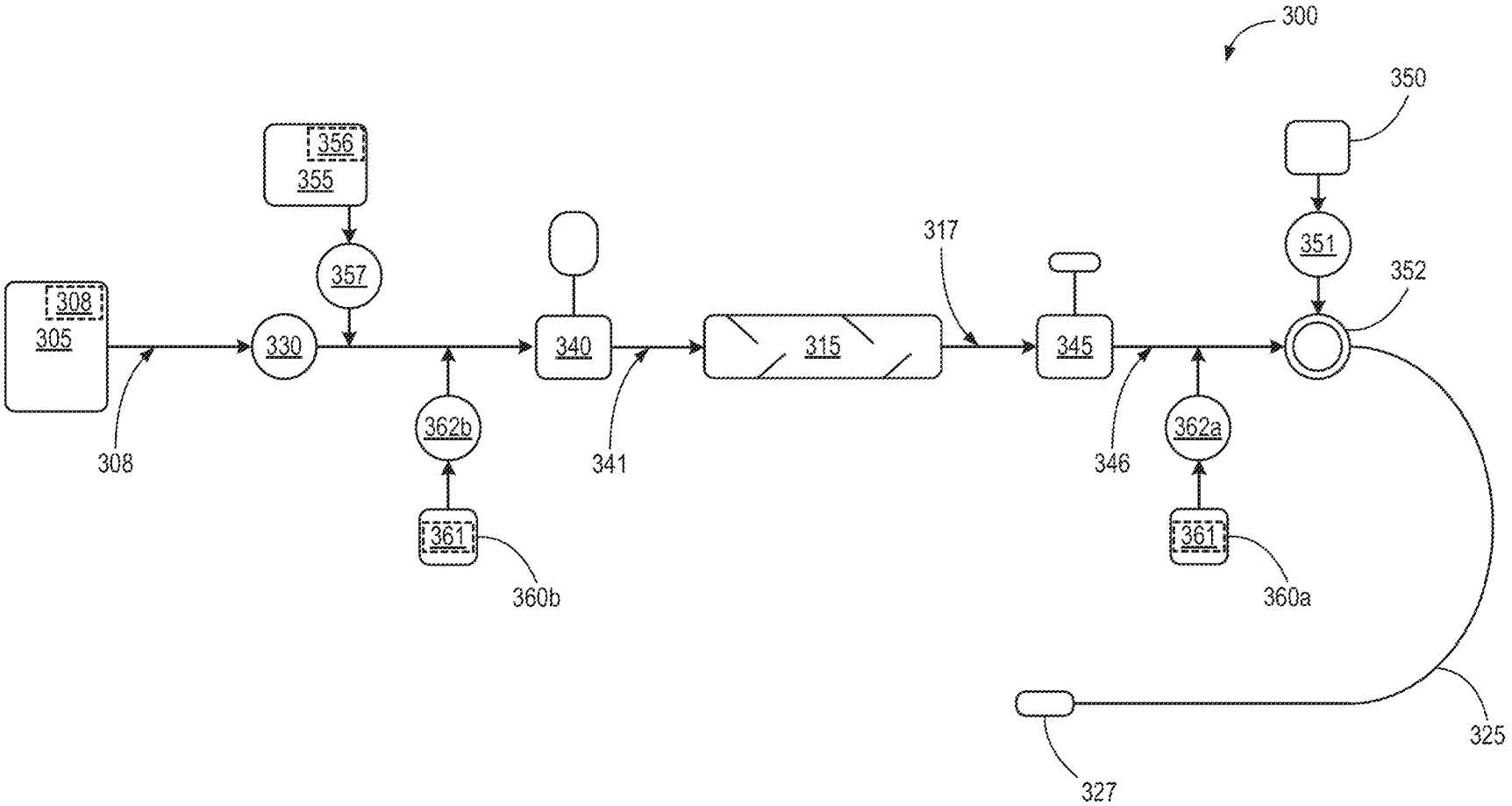
FIG. 3 is a process flow diagram of another embodiment of an explosives delivery system.

FIG. 3 illustrates a process flow diagram of an explosives delivery system 300. In some embodiments, the explosives delivery system 300 includes a first reservoir 305 configured to store a first mixed product 308, wherein the first mixed product 308 includes an emulsion matrix and a homogenizing agent. In certain embodiments, the first mixed product 308 may be formed by one of the explosives delivery systems 100, 200. Accordingly, the first mixed product 308 may be conveyed from one of the explosives delivery systems 100, 200 to the first reservoir 305.

The explosives delivery system 300 can also include a first homogenizer 340 configured to homogenize the first mixed product 308 into a first homogenized product 341. The first homogenizer 340 can be operably connected to the first reservoir 305. As shown, a delivery conduit 325 can be operably connected to the first homogenizer 340 and the delivery conduit 325 can be configured to convey a homogenized product (e.g., the first homogenized product 341) to a blasthole.

As used herein, "homogenize" or "homogenizing" refers to reducing the size of oxidizer phase droplets in the fuel phase of an emulsion matrix (e.g., such as the emulsion matrix in the mixed product 308). Homogenizing the emulsion matrix increases the viscosity (or solid-like behavior) of the first homogenized product 341 as compared to the emulsion matrix. Likewise, homogenizing the first homogenized product 341 may further increase the viscosity of a second homogenized product 346 as compared to the first homogenized product 341.

In various embodiments, the explosives delivery system 300 may include a first pump 330. A first inlet of the first pump 330 can be fluidically connected to the first reservoir 305 and an outlet of the first pump 330 can be fluidically connected to the first homogenizer 340. Stated another way, the first pump 330 may be in fluid communication with one or more of the first reservoir 305 and the first homogenizer 340.

In some embodiments, the explosives delivery system 300 can include a third reservoir 355 configured to store a first gassing agent 356. A stream of the first gassing agent 356 can be fluidically coupled to a stream including the emulsion matrix at a position upstream of the first homogenizer 340. As depicted, the stream of the first gassing agent 356 can be fluidically coupled to the stream including the emulsion matrix via a pump 357. An inlet of the pump 357 may be fluidically connected to the third reservoir 355 and an outlet of the third pump may be fluidically connected to the feed stream for the first homogenizer 340.

The first homogenizer 340 may be configured to reduce the size of oxidizer phase droplets by introducing a shearing stress on the emulsion matrix and the first gassing agent 356. The first homogenizer 340 may include a valve configured to introduce a shearing stress (referred to herein as a "shearing valve") on the emulsion matrix and the first gassing agent 356. The gap between the valve seat and the valve body, which is controlled by how open the valve is, determines how much shear the emulsion matrix experiences. In some embodiments, the first homogenizer 340 may be configured to introduce high shear on a stream comprising the emulsion matrix.

In certain embodiments, the first gassing agent 356 may include a pH control agent. The pH control agent may comprise an acid. Examples of acids include, but are not limited to, organic acids such as citric acid, acetic acid, and tartaric acid. Any pH control agent known in the art and compatible with a second gassing agent 361 (described below) and/or a gassing accelerator, if present, may be used. The pH control agent may be dissolved in an aqueous solution.

In various embodiments, the explosives delivery system 300 may optionally include a second homogenizer 345 disposed between the first homogenizer 340 and a downstream end of the delivery conduit 325. The second homogenizer 345 may be configured to further homogenize the first homogenized product 341 into the second homogenized product 346. The first and second homogenizers 340, 345 can be independently selected from one of a dynamic homogenizer or a static homogenizer. For example, the first homogenizer 340 may be a dynamic homogenizer and the second homogenizer 345 may be a static homogenizer. In another example, both the first and second homogenizers 340, 345 may be dynamic homogenizers. Other combinations of first and second homogenizers 340, 345 are also within the scope of this disclosure.

An example of a dynamic homogenizer is a hydraulically or pneumatically-actuated shearing valve. By way of background information, hydraulic fluid and compressed air are compressible and expandable to varying extents. With any process, pressure changes in a process stream generally occur. Referring again to the present embodiments, as pressure changes in flowing emulsion matrix stream occur, the hydraulic fluid or compressed air compresses or expands to some extent, allowing the valve seat to fluctuate slightly. This changes the amount of shear experienced by the stream of emulsion matrix, depending on the pressure of the emulsion matrix stream. Therefore, such homogenizers are considered "dynamic."

In contrast, an example of a static homogenizer is a shearing valve actuated by a threaded shaft (e.g., manual or motor-actuated). As pressure changes in the flowing emulsion matrix stream occur, the threaded shaft does not allow the valve seat to fluctuate much. The amount of shear experienced by the stream of emulsion matrix does not change much as the pressure of the emulsion matrix stream fluctuates. Therefore, such homogenizers are considered "static."

In some embodiments, the explosives delivery system 300 may include a fourth reservoir 360*a*, 360*b* configured to store a second gassing agent 361. In various embodiments, the second gassing agent 361 can include a chemical gassing agent. Examples of the chemical gassing agents include, but are not limited to, peroxides such as hydrogen peroxide, inorganic nitrite salts such as sodium nitrite, nitrosamines such as N,N'-dinitrosopentamethylenetetramine, alkali metal borohydrides such as sodium borohydride, and bases such as carbonates including sodium carbonate. Any chemical gassing agent known in the art and compatible with the emulsion matrix and/or a gassing accelerator, if present, may be used. The chemical gassing agent may be dissolved in an aqueous solution.

In certain embodiments including the fourth reservoir 360*a*, a stream of the second gassing agent 361 can be fluidically coupled via a pump 362*a* to a stream of the first homogenized product 341 (or a stream of the second homogenized product 346) at a position downstream of the first homogenizer 340. Furthermore, the explosives delivery system 300 may include a second mixer (not shown), wherein the second mixer is configured to mix the second gassing agent 361 with the first homogenized product 341.

In certain other embodiments including the fourth reservoir 360*b*, a stream of the second gassing agent 361 can be fluidically coupled via a pump 362*b* to a stream of the emulsion matrix and the homogenizing agent at a position upstream of the first homogenizer 340. Furthermore, the explosives delivery system 300 may include a second mixer (not shown), wherein the second mixer is configured to mix the second gassing agent 361 with the stream of the emulsion matrix and the homogenizing agent While FIG. 3 depicts two fourth reservoirs (i.e., fourth reservoirs 360*a* and 360*b*), in use, the explosives delivery system 300 generally includes only one of the fourth reservoirs 360*a*, 360*b* configured to store the second gassing agent 361; however, the single fourth reservoir can be operably connected upstream or downstream of the first homogenizer 340 and/or upstream or downstream of the second homogenizer 345.

In certain embodiments, the explosives delivery system 300 may include a first mixer 315 configured to mix the first mixed product 308 to a second mixed product 317. For example, the first mixer 315 can be configured to mix the first mixed product 308 with the first gassing agent 356 and/or the second gassing agent 361 to form the second mixed product 317. The first mixer 315 can be operably connected to the first reservoir 305 and/or the first homogenizer 340. As shown, the first mixer 315 can be disposed downstream of the first homogenizer 340. In certain other embodiments, the first mixer 315 can be disposed upstream of the first homogenizer 340 or downstream of the second homogenizer 345 (when the second homogenizer 345 is present). As discussed above, the first mixer 315 can be a static mixer or any other suitable mixer.

Furthermore, as depicted, a spray nozzle 327 can be coupled to a downstream end of the delivery conduit 325. In certain embodiments, the spray nozzle 327 can be configured for mixing (e.g., for mixing the first or the second homogenized product 341, 346). The spray nozzle 327 may be configured to convey the first or the second homogenized product 341, 346 to a blasthole. The spray nozzle 327 may include a mixer (not shown) within an inner surface of the spray nozzle 327; however, the spray nozzle 327 itself may provide sufficient mixing.

In certain embodiments, the explosives delivery system 300 can also include a water injector 350 and pump 351 configured to introduce water into the delivery conduit 325. As depicted, the water injector 350 can include a water ring 352. In various embodiments, the water (e.g., the water introduced by the water injector 350) can include a second gassing agent.

Figure 4:
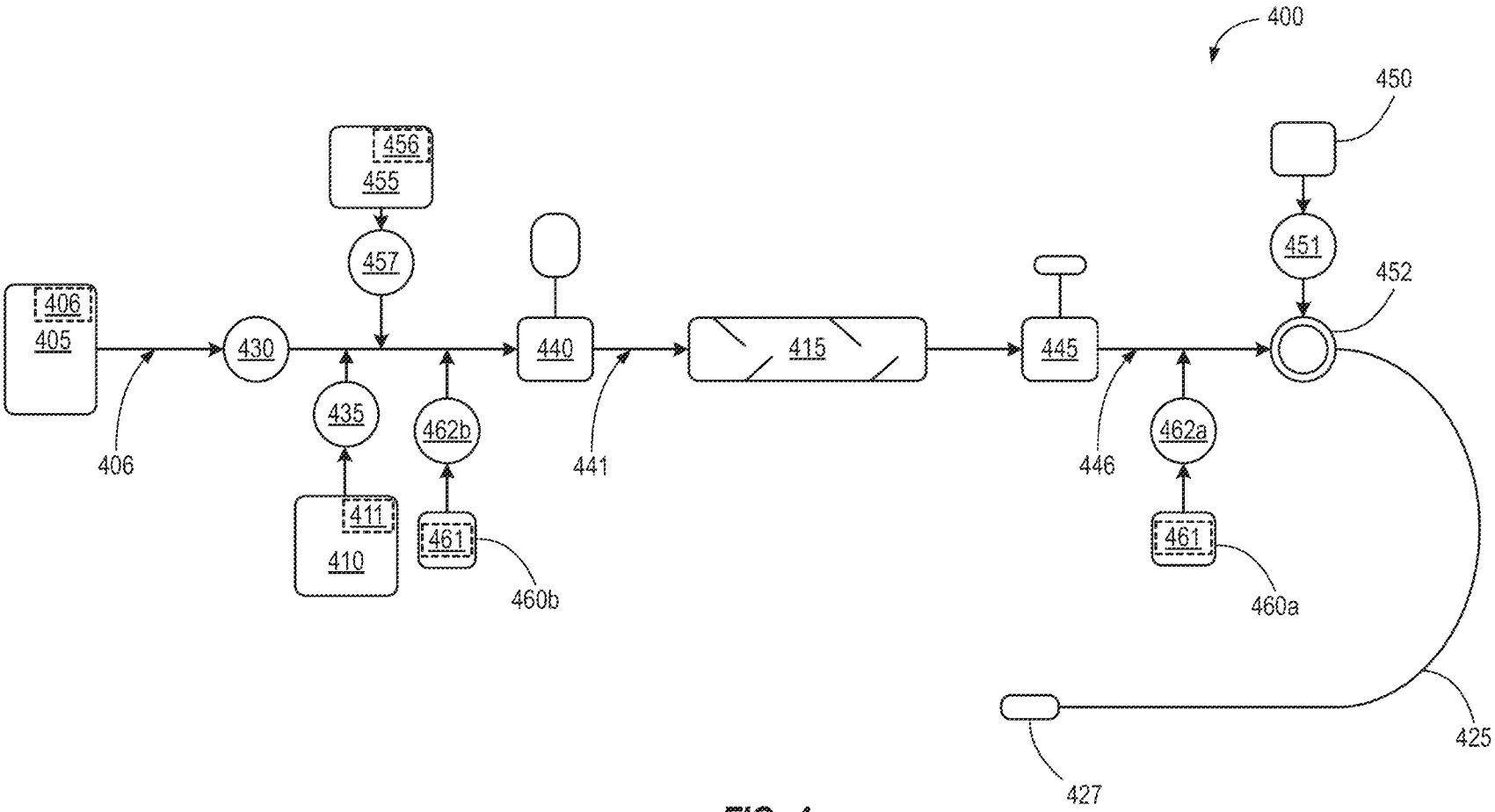
FIG. 4 is a process flow diagram of another embodiment of an explosives delivery system.

It should be understood that systems 100 or 200 can be combined with system 300. FIG. 4 illustrates a process flow diagram of an explosives delivery system 400 that illustrates an embodiment of such a combination. The explosives delivery system 400 can include a first reservoir 405 configured to store an emulsion matrix 406, a second reservoir 410 configured to store a homogenizing agent 411, and a first homogenizer 440 configured to homogenize the emulsion matrix 406 and the homogenizing agent 411 into a first homogenized product 441.

The first homogenizer 440 can be operably connected to the first reservoir 405 and the second reservoir 410. As shown, a delivery conduit 425 can be operably connected to the first homogenizer 440 and the delivery conduit 425 can be configured to convey a homogenized product (e.g., the first homogenized product 441, a second homogenized product 446, etc.) to a blasthole. Furthermore, the first homogenizer 440 may be configured to introduce high shear on a stream comprising the emulsion matrix 406.

In certain embodiments, the explosives delivery system 400 may include a first mixer 415 configured to mix the emulsion matrix 406 and the homogenizing agent 411. The first mixer 415 can be operably connected to the first reservoir 405, the second reservoir 410, and/or the first homogenizer 440. As shown, the first mixer 415 can be disposed downstream of the first homogenizer 440. In certain other embodiments, the first mixer 415 or an additional mixer can be disposed upstream of the first homogenizer 440.

The explosives delivery system 400 may include a first pump 430. An inlet of the first pump 430 can be fluidically connected to the first reservoir 405 and an outlet of the first pump 430 can be fluidically connected to a feed stream of the first homogenizer 440. The inlet of a second pump 435 can be fluidically connected to the second reservoir 410 and an outlet of the second pump 435 is fluidically connected to the feed stream of the first homogenizer 440. In contrast to the explosives delivery system 300, the explosives delivery system 400 is configured to mix the homogenizing agent with the emulsion matrix as part of the system, such as on a mobile processing unit.

In some embodiments, the explosives delivery system 400 can include a third reservoir 455 configured to store a first gassing agent 456. A stream of the first gassing agent 456 can be fluidically coupled to a stream including the emulsion matrix 406 at a position upstream of the first homogenizer 440 (i.e., the feed stream of the first homogenizer 440). In certain embodiments, the first gassing agent 456 can be a pH control agent as discussed above. The explosives delivery system 400 may also include a third pump 457 configured to convey the first gassing agent 456 to the stream including the emulsion matrix 406. An inlet of the third pump 457 may be fluidically connected to the third reservoir 455 and an outlet of the third pump may be fluidically connected to the feed stream of the first homogenizer 440.

In various embodiments, the explosives delivery system 400 may optionally include a second homogenizer 445 disposed between the first homogenizer 440 and a downstream end of the delivery conduit 425. The second homogenizer 445 may be configured to further homogenize the first homogenized product 441 into a second homogenized product 446. The first and second homogenizers 440, 445 can be independently selected from one of a dynamic homogenizer or a static homogenizer.

In some embodiments, the explosives delivery system 400 may include a fourth reservoir 460*a*, 460*b* configured to store a second gassing agent 461. Stated another way, the explosives delivery system 400 may include one of the fourth reservoir 460*a* or the fourth reservoir 460*b*. While FIG. 4 depicts two fourth reservoirs (i.e., the fourth reservoirs 460*a* and 460*b*), in use, the explosives delivery system 400 generally includes only one of the fourth reservoirs 460*a*, 460*b* configured to store the second gassing agent 461. The second gassing agent 461 can include a chemical gassing agent as discussed above.

In certain embodiments including the fourth reservoir 460*a*, a stream of the second gassing agent 461 can be fluidically coupled via a pump 462*a* to a stream of the first homogenized product 441 at a position downstream of the first homogenizer 440. Furthermore, the explosives delivery system 400 may include a second mixer (not shown), wherein the second mixer is configured to mix the second gassing agent 461 with the stream of the first homogenized product 441 (or the second homogenized product 446). In certain other embodiments including the fourth reservoir 460*b*, a stream of the second gassing agent 461 can be fluidically coupled via a pump 462*b* to a stream of the emulsion matrix 406 and the homogenizing agent 411 at a position upstream of the first homogenizer 440. Furthermore, the explosives delivery system 400 may include a second mixer (not shown), wherein the second mixer is configured to mix the second gassing agent 461 with the stream of the emulsion matrix 406 and the homogenizing agent 411.

Furthermore, as depicted, a spray nozzle 427 can be coupled to a downstream end of the delivery conduit 425. In certain embodiments, the spray nozzle 427 can be configured for mixing (e.g., for mixing the second homogenized product 446).

In certain embodiments, the explosives delivery system 400 can also include a water injector 450 and pump 451 configured to introduce water into the delivery conduit 425. As depicted, the water injector 450 can include a water ring 452. In various embodiments, the water (e.g., the water introduced by the water injector 450) can include a second gassing agent. It should further be understood that FIGS. 1-4 are process flow diagrams and do not dictate physical location of any of the components.

The explosives delivery systems 100, 200, 300, 400 may allow or permit an explosives manufacturer to manufacture a single emulsion matrix for use in both underground and surface applications. If the emulsion matrix is to be used in an underground application, a user may add a homogenizing agent to the emulsion matrix after manufacture of the emulsion matrix. For example, the user may add the homogenizing agent to the emulsion matrix after the manufacture of the emulsion matrix but at a predetermined time point before use of the emulsion matrix. Accordingly, the shelf life of the emulsion matrix may be longer than the shelf life of an emulsion matrix including a homogenizing agent that was added at the time of manufacture (i.e., by the manufacturer). The user can also increase the viscosity of the emulsion matrix by the application of shear to the emulsion matrix. Furthermore, the emulsion matrix can be configured to be retainable in an up-hole without a substantial reduction in the sleep time of the emulsion matrix.

Another aspect of the disclosure is related to methods of delivering explosives. In some embodiments, the method may include selecting an emulsion matrix tailored to the properties of the material to be blasted, supplying the emulsion matrix, mixing a homogenizing agent with the emulsion matrix into a mixed product, homogenizing the mixed product into a homogenized product, sensitizing the homogenized product, and/or conveying the sensitized product to a blasthole.

In certain embodiments, the blasthole may be an underground blasthole and the emulsion matrix may be an emulsion matrix configured or used for surface blasting. A benefit of the methods provided herein may be that the emulsion matrix can be tailored to the hardness of the rock to be blasted, as there generally tends to be a wide variety of surface emulsion matrices. For example, the method may include determining rock and/or ore properties along the length or depth of the blasthole. Examples of rock and/or ore properties include, but are not limited to, solid density, unconfined compressive strength, Young's modulus, and Poisson's ratio. Methods of determining rock and/or ore properties are known in the art and, thus, are not disclosed herein. Knowledge of the rock and/or ore properties may be used by one skilled in the art to select an emulsion matrix tailored to characteristics of the blasthole, rock, and/or ore to achieve optimum performance of the explosive.

In various embodiments, the emulsion matrix can be supplied devoid, or substantially devoid, of the homogenizing agent (e.g., for use with one of the explosives delivery systems 100, 200, 400). In various other embodiments, the emulsion matrix can be supplied devoid, or substantially devoid, of the homogenizing agent, but the homogenizing agent is mixed with the emulsion matrix prior to the emulsion matrix being loaded into a reservoir on the mobile processing unit (e.g., as with the explosives delivery system 300). In other embodiments, a homogenizing agent may be present in the emulsion matrix, but additional homogenizing agent is mixed with the emulsion matrix prior to homogenizing the emulsion matrix. The weight percent (wt %) of the homogenizing agent (or additional homogenizing agent) in the mixed product may be about 0.5 wt % to about 2.0 wt %, about 0.5 wt % to about 1.5 wt %, about 0.5 wt % to about 1.0 wt %, about 0.7 wt %, about 0.8 wt %, or about 0.75 wt %.

The level of crystallization of the homogenized product can be measured using microscopy, among other methods. One skilled in the art, with the benefit of the present disclosure, can determine the percent crystallinity using known methods. The homogenized product can be devoid, or substantially devoid, of crystallization. Therefore, external homogenization can be used without destabilizing the emulsion matrix.

In certain embodiments, the homogenizing agent can be mixed with the emulsion matrix prior to disposition of the mixed product on a mobile processing unit. In certain other embodiments, the homogenizing agent may be mixed with the emulsion matrix after disposition of the mixed product on the mobile processing unit.

Prior to the addition of the homogenizing agent and prior to the mixing and/or the homogenizing steps as discussed above, the viscosity of the emulsion matrix may be between about 20 and 70 kcP, between about 25 and 60 kcP, between about 25 and 50 kcP, or less than about 40 kcP. Furthermore, after the addition of the homogenizing agent and after the mixing and/or the homogenizing steps as discussed above, the viscosity of the homogenized product may be greater than about 120 kcP, greater than about 140 kcP, greater than about 150 kcP, or greater than about 160 kcP. For example, the viscosity of the homogenized product after the mixing and homogenizing steps may be about 120 kcP to about 300 kcP, about 140 kcP to about 275 kcP, or about 160 kcP to about 250 kcP. The addition of the homogenizing agent, the homogenizing step(s), and/or the mixing step(s) may increase the viscosity of the emulsion matrix. For example, the change in viscosity between the emulsion matrix and the homogenized product after the mixing and homogenizing steps may be about 50 kcP to about 300 kcP, about 60 kcP to about 250 kcP, or about 70 kcP to about 200 kcP. As noted above, increasing the viscosity of the emulsion matrix can enhance the suitability of the emulsion matrix for use in underground applications. For example, the increased viscosity may aid in retaining the emulsion matrix in an up-hole without loss from the up-hole.

EXAMPLES

The following examples are illustrative of disclosed methods and compositions. In light of this disclosure, those of skill in the art will recognize that variations of these examples and other examples of the disclosed methods and compositions would be possible without undue experimentation.

Example 1

Figure 5:
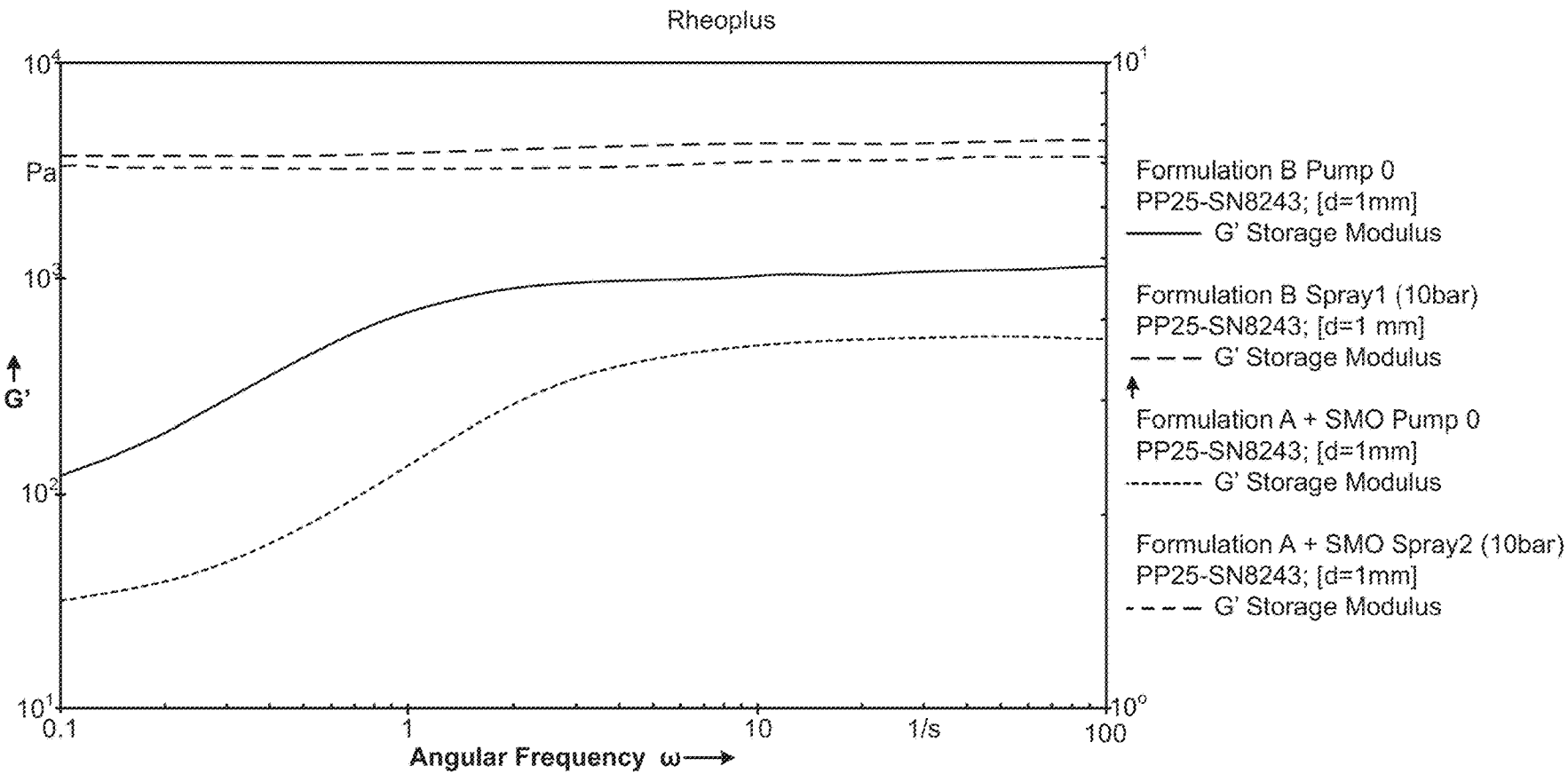
FIG. 5 is a graph depicting the storage modulus (G') of sprayed and non-sprayed samples.

Formulation A is an emulsion matrix for use in hard rock and narrow diameter surface applications. Formulation A was mixed with 0.6 wt % solution of SMO and diesel (1:1 ratio) and sprayed through a 3 mm diameter nozzle. The same spray process was repeated for Formulation B, an emulsion matrix used for underground applications that contains SMO added during manufacture of the emulsion matrix. FIG. 5 shows an increase in the storage modulus (G') from the no spraying to the sprayed sample. This indicates that there is an increase in the solid-like behavior of Formulation A when mixed with SMO, with a sprayed storage modulus comparable to that of Formulation B. The composition of Formulations A and B are provided in Table 1 below.

TABLE 1

| | Formulation B | Formulation A |
|---|---|---|
| Ammonium Nitrate (AN) | 69 | 75 |
| Sodium Nitrate (SN) | 10 | — |
| Sodium Thiocyanate | 0.1 | 0.1 |
| Urea | 1 | 4 |
| Water | 14 | 15 |
| PIBSA Emulsifiers | 1 | 1 |
| SMO | 0.3 | 0.3 (post-mixing with SMO) |
| Mineral Oil | 5 | 1 |
| Diesel | 0 | 4 |

Example 2

A number of different additives were tested, at the same ratio as in Example 1, to determine if they increase the viscosity of Formulation A. The Viscosity Increase (VINC) test was applied. Briefly, 100 g of emulsion was stressed using a small jiffy blade in a Lightnin Mixer at 1500 rpm. The temperature and viscosity were measured before ($Temp_1$ and $Visc_1$, respectively) and after ($Temp_2$ and $Visc_2$, respectively) stressing. Viscosity was determined with a Brookfield RVDV-II with a spindle 7 at 20 rpm. The results of these tests are depicted in Table 2 below.

TABLE 2

VINC test results of trialed external homogenization agents

| Sample Description | $Temp_1$ (° C.) | $Visc_1$ (cP) | $Temp_2$ (° C.) | $Visc_2$ (cP) | Visc Increase (%) |
|---|---|---|---|---|---|
| 1. Formulation B | 16.5 | 74200 | 16.7 | 94600 | 27 |
| 2. Formulation A + SMO[1] | 14.5 | 32200 | 16.8 | 38400 | 19 |
| 3. Formulation A + Sorbitan Dioleate[2] | 17.2 | 36600 | 18.1 | 40200 | 10 |
| 4. Formulation A + Sorbitan Sesquioleate[2] | 17.8 | 35600 | 19.0 | 40400 | 13 |
| 5. Formulation A + Oleic Acid[2] | 19.2 | 39600 | 19.4 | 42800 | 8 |
| 6. Formulation A + Oleic Acid TEA[2] | 11.3 | 32200 | 12.1 | 39800 | 24 |
| 7. Formulation A + Sorbitan Di-isostearate[2] | 11.8 | 35600 | 12.7 | 38800 | 9 |
| 8. Formulation A + Sorbitan Trioleate[2] | 12.4 | 40800 | 13.7 | 45200 | 11 |
| 9. Formulation A + Oleic Acid/Stearate TEA[2] | 14.4 | 35600 | 15.6 | 37200 | 4 |
| 10. Formulation A + Canola[2] | 15.2 | 39600 | 15.7 | 41000 | 4 |
| 11. Formulation A + Adipic DEEA[2] | 15.2 | 54600 | 16.2 | 60600 | 11 |
| 12. Formulation A + Adipic TEA[2] | 14.9 | 54400 | 15.5 | 57600 | 6 |

[1]Post-mixed, see Table 1
[2]Instead of SMO

Example 3

In light of the data obtained as described in Example 2, a scaled-up spray trial was conducted. An underground delivery vehicle was used having three trace injection points, which are used for sensitization and lubrication for delivery of an emulsion. An acid line enters the emulsion prior to a monopump, which allows the monopump to mix the acid and emulsion together.

Figure 6:
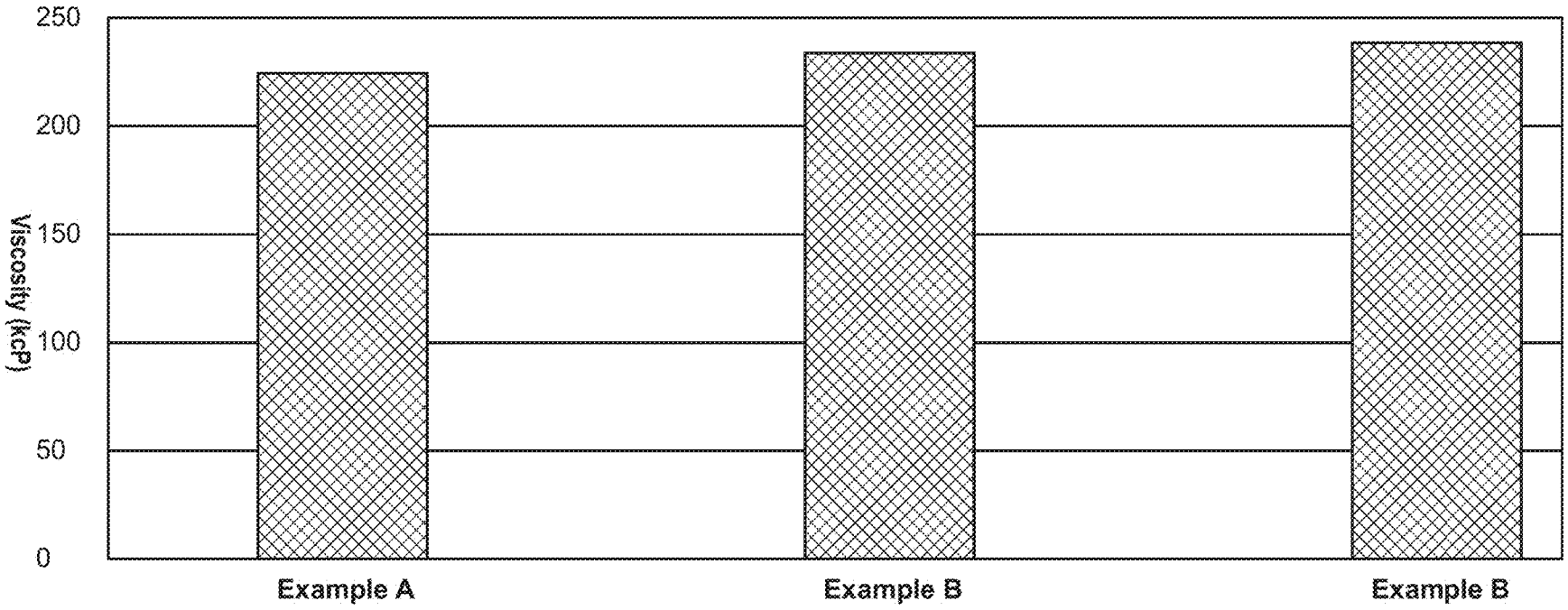
FIG. 6 is a graph depicting the spray viscosity of multiple samples.
Figure 7:
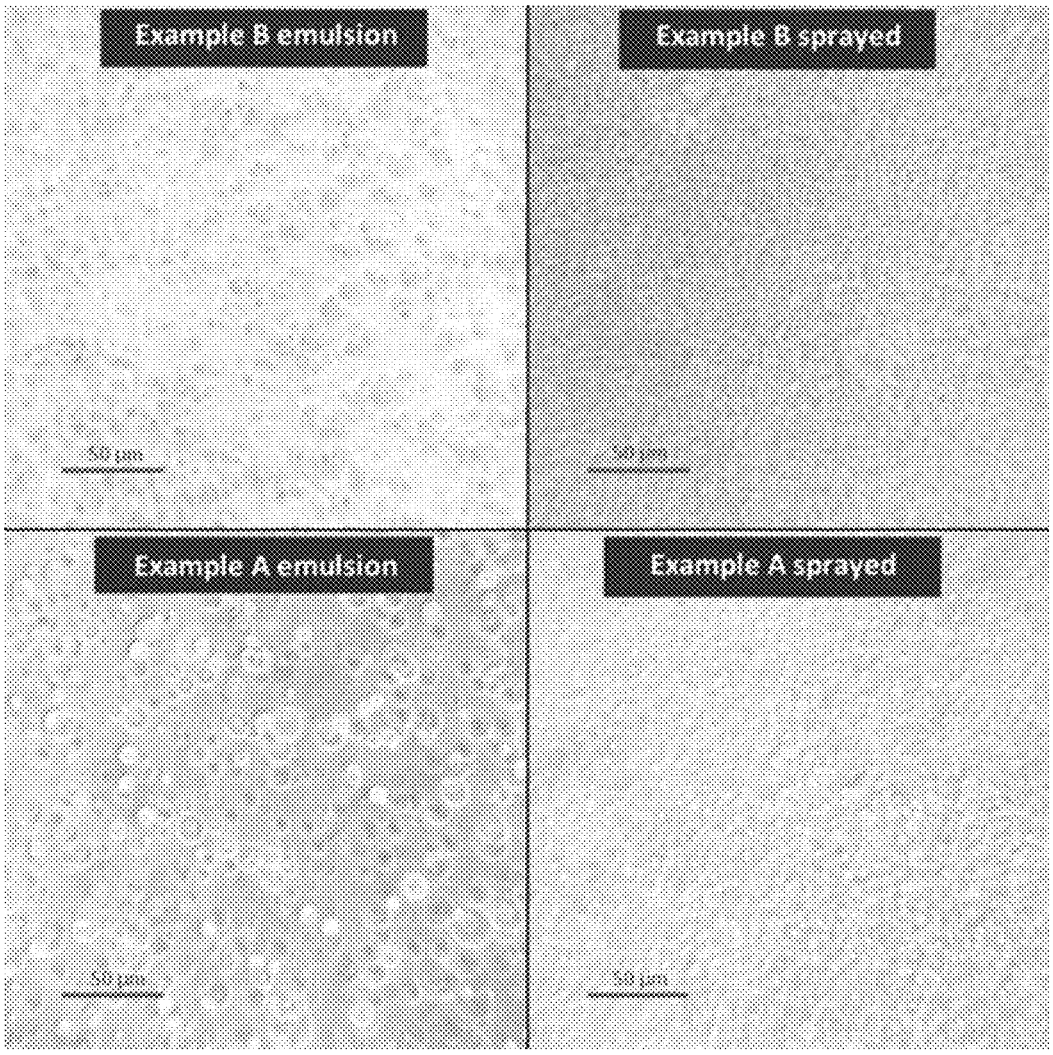
FIG. 7 depicts a microscope image of two different samples before and after spraying.

SMO was added at a rate 0.75 wt % of the Formulation A, resulting in a viscosity increase to 200,000 cP when using a Brookfield RVDV-II with a spindle 7 at 20 rpm. Formulation B was homogenized the same way without any external addition of SMO and the same viscosity was obtained. FIG. 6 shows the spray viscosity of Formulation A plus 0.75 wt % SMO (Example A) in comparison to the spray viscosity of Formulation B (Example B) without external addition of SMO. FIG. 7 shows that no crystallization was present either before homogenizing (left panel) or after homogenizing and spraying (right panel) for both Example A and Example B.

Example 4

Formulation A and Formulation B were externally homogenized as described in Example 3 and then loaded into clear, vertical pipes. Both products were retained in the vertical pipes without significant slumping.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A method of delivering explosives comprising:
- supplying an emulsion matrix from a first reservoir, said emulsion matrix comprising a continuous fuel phase and a discontinuous oxidizer phase;
- supplying a homogenizing agent from a second reservoir;
- conveying the emulsion matrix and the homogenizing agent to a mixer;
- mixing the homogenizing agent with the emulsion matrix with the mixer to produce a mixed product;
- homogenizing the mixed product into a homogenized product;
- sensitizing the homogenized product; and
- conveying the sensitized product to a blasthole.

2. The method of claim 1, wherein the blasthole is an underground blasthole and wherein the emulsion matrix comprises an emulsion matrix used for surface blasting.

3. The method of claim 1, further comprising selecting an emulsion matrix tailored to the hardness of the rock to be blasted.

4. The method of claim 1, wherein the emulsion matrix is supplied substantially devoid of the homogenizing agent.

5. The method of claim 1, wherein the weight percent (wt %) of the homogenizing agent in the mixed product is about 0.2 wt % to about 1.5 wt %.

6. The method of claim 1, wherein the homogenized product is substantially devoid of crystallization.

7. The method of claim 1, wherein the homogenizing agent is mixed with the emulsion matrix prior to disposition of the mixed product on a mobile processing unit.

8. The method of claim 1, wherein the homogenizing agent is mixed with the emulsion matrix after disposition on a mobile processing unit.

9. The method of claim 1, wherein the viscosity of the emulsion matrix is about 20 to about 70 kcP, and wherein the viscosity of the homogenized product is about 120 kcP to about 300 kcP.

10. The method of claim 1, wherein the homogenizing agent and the emulsion matrix are mixed into the mixed product with a static mixer.

11. The method of claim 1, wherein the homogenizing agent is selected from at least one of sorbitan monooleate, sorbitan dioleate, sorbitan trioleate, sorbitan sesquioleate, sorbitan diisostearate, oleic acid, oleic acid TEA, oleic acid/stearate TEA, adipic DEEA, adipic TEA, animal fats, lard, PIBSA, PIBSA derivatives, dicarboxylic acids, dimerized fatty acids, trimerized fatty acids, and vegetable oil.

12. The method of claim 11, wherein the homogenizing agent comprises sorbitan monooleate (SMO).

13. The method of claim 1, wherein the emulsion matrix comprises an emulsifier distinct from the homogenizing agent.

14. The method of claim 1, comprising:
- further homogenizing the homogenized product into a second homogenized product.

15. A method of delivering explosives comprising:
- supplying an emulsion matrix from a first reservoir, said emulsion matrix comprising a continuous fuel phase and a discontinuous oxidizer phase;
- supplying a homogenizing agent from a second reservoir;
- conveying the emulsion matrix and the homogenizing agent to a homogenizer:
- homogenizing the emulsion matrix and the homogenizing agent with the homogenizer to produce a homogenized product;
- sensitizing the homogenized product; and
- conveying the sensitized product to a blasthole.

16. The method of claim 15, wherein the emulsion matrix is supplied substantially devoid of the homogenizing agent.

17. The method of claim 15, wherein the viscosity of the emulsion matrix is about 20 to about 70 kcP, and wherein the viscosity of the homogenized product is about 120 kcP to about 300 kcP.

18. The method of claim 15, wherein the homogenizing agent is selected from at least one of sorbitan monooleate, sorbitan dioleate, sorbitan trioleate, sorbitan sesquioleate, sorbitan diisostearate, oleic acid, oleic acid TEA, oleic acid/stearate TEA, adipic DEEA, adipic TEA, animal fats, lard, PIBSA, PIBSA derivatives, dicarboxylic acids, dimerized fatty acids, trimerized fatty acids, and vegetable oil.

19. A method of delivering explosives comprising:
- supplying an emulsion matrix from a first reservoir, said emulsion matrix comprising a continuous fuel phase and a discontinuous oxidizer phase, wherein the emulsion matrix as supplied from the first reservoir is substantially devoid of a homogenizing agent;
- supplying the homogenizing agent from a second reservoir, wherein the homogenizing agent is selected from at least one of sorbitan monooleate, sorbitan dioleate, sorbitan trioleate, sorbitan sesquioleate, sorbitan diisostearate, oleic acid, oleic acid TEA, oleic acid/stearate TEA, adipic DEEA, adipic TEA, animal fats, lard, PIBSA, PIBSA derivatives, dicarboxylic acids, dimerized fatty acids, trimerized fatty acids, and vegetable oil;
- conveying the emulsion matrix and the homogenizing agent to a homogenizer:
- homogenizing the emulsion matrix and the homogenizing agent with the homogenizer to produce a homogenized product;
- sensitizing the homogenized product; and
- conveying the sensitized product to a blasthole.

20. The method of claim 19, wherein the viscosity of the emulsion matrix is about 20 to about 70 kcP, and wherein the viscosity of the homogenized product is about 120 kcP to about 300 kcP.

* * * * *